US006200191B1

(12) United States Patent
Chou

(10) Patent No.: US 6,200,191 B1
(45) **Date of Patent: *Mar. 13, 2001**

(54) STRUCTURE OF MOTION TOY

(75) Inventor: Jin-Long Chou, Taipei Hsien (TW)

(73) Assignee: Blue Ridge Designs, Inc., Boone, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/234,298

(22) Filed: Jan. 21, 1999

Related U.S. Application Data

(63) Continuation of application No. 09/014,102, filed on Jan. 27, 1998, now Pat. No. 5,911,617.

(51) Int. Cl.[7] ..... A63H 11/00
(52) U.S. Cl. ..... 446/353; 446/330
(58) Field of Search ..... 446/330, 353, 446/354, 356, 358, 352; 40/46, 415, 417, 418, 419, 420

(56) References Cited

U.S. PATENT DOCUMENTS

| | | | |
|---|---|---|---|
| 674,970 | 5/1901 | Kennedy . | |
| 711,510 | 10/1902 | Little . | |
| 1,415,344 | 5/1922 | Haskell . | |
| 1,423,383 | 7/1922 | Zaiden . | |
| 1,661,093 | 2/1928 | Rogers . | |
| 1,674,943 | 6/1928 | Berger . | |
| 1,685,358 | 9/1928 | Harcourt . | |
| 2,637,936 | 5/1953 | Dale et al. . | |
| 2,691,845 | 10/1954 | Jepson . | |
| 3,613,299 | 10/1971 | Amici et al. . | |
| 3,643,374 | 2/1972 | Gunther et al. . | |
| 3,660,931 | 5/1972 | Gardel et al. . | |
| 3,858,353 | 1/1975 | Glass et al. . | |
| 3,888,023 | 6/1975 | Genin . | |
| 4,040,206 | 8/1977 | Kimura . | |
| 4,136,874 | 1/1979 | McCord . | |
| 4,505,472 | 3/1985 | Lorenc et al. . | |
| 4,545,775 | 10/1985 | Kim . | |
| 4,676,764 | 6/1987 | Yeu . | |
| 4,801,285 | 1/1989 | Yeu . | |
| 4,828,530 | 5/1989 | Lee . | |
| 4,836,819 | 6/1989 | Oishi et al. . | |
| 4,846,752 | 7/1989 | Combs . | |
| 4,867,730 | 9/1989 | Lee . | |
| 4,869,703 | 9/1989 | Ong . | |
| 4,878,878 | 11/1989 | Bittner . | |
| 4,901,459 | 2/1990 | Lee . | |
| 4,944,708 | 7/1990 | Kawabe . | |
| 5,022,533 | 6/1991 | Lin . | |
| 5,147,238 | 9/1992 | Kelley et al. . | |
| 5,176,560 | 1/1993 | Wetherell et al. . | |
| 5,205,775 | 4/1993 | Brodrib . | |
| 5,224,896 | 7/1993 | Terzian . | |
| 5,259,806 | 11/1993 | Chang . | |
| 5,273,479 | 12/1993 | Chang . | |
| 5,609,340 | 3/1997 | Chuang . | |
| 5,735,726 | 4/1998 | Cohen . | |
| 5,911,617 * | 6/1999 | Chou | 446/353 |
| 5,941,756 * | 8/1999 | Chou | 446/330 |
| 6,071,170 * | 6/2000 | How | 446/330 |

FOREIGN PATENT DOCUMENTS

| | | |
|---|---|---|
| 535765 | 12/1958 | (BE) . |

* cited by examiner

*Primary Examiner*—D. Neal Muir
(74) *Attorney, Agent, or Firm*—Smith, Gambrell & Russell, LLP

(57) ABSTRACT

A motion toy includes a toy body having an upper part and a lower part pivotally connected together, and a power drive coupled between the upper part and the lower part of the toy body. The power drive is controlled to tilt the upper part and the lower part of the toy body alternatively inward and outward in reversed directions.

79 Claims, 8 Drawing Sheets

STRUCTURE OF MOTION TOY

CONTINUING APPLICATION DATA

This application is a continuation based on U.S. patent application Ser. No. 09/014,102, filed Jan. 27, 1998, now U.S. Pat. No. 5,911,617, issued Jun. 15, 1999, which application is entirely incorporated herein by reference.

BACKGROUND OF THE INVENTION

The present invention relates to motion toys, and more particularly to a motion toy which uses a reversible motor to turn a transmission gear through a belt transmission mechanism in moving two main racks on two leg cover shells in reversed directions, causing the upper part and the lower part of the toy body to alternatively tilt inward and outward in reversed directions.

A variety of motion toys have been disclosed and have appeared on the market. These motion toys commonly use a motor to turn a transmission gear train, causing the transmission gear train to move eccentric rods or cams, so as to move movable parts of the toy back and forth. This motion mode is monotonous and less attractive.

SUMMARY OF THE INVENTION

The present invention provides a motion toy which comprises a toy body, and a power drive mounted inside the toy body and controlled to move the toy body, causing the toy body to twist. The toy body comprises a shoulder cover unit including two symmetrical shoulder cover shells connected together; two foot base members, two trunk cover shells respectively connected to the shoulder cover shells, the trunk cover shells each having a pair of racks bilaterally disposed at a bottom side; two symmetrical waist cover shells respectively each having a top end; respectively pivoted to the shoulder cover shells between the trunk cover shells and a bottom end, a bottom bracket coupled between the bottom ends of the waist cover shells and turned about a pivot between the trunk cover shells; and two symmetrical pairs of leg cover shells bilaterally connected between the foot base members and the waist cover shells, the leg cover shells each having a top end respectively pivoted to the bottom ends of the waist cover shells, a bottom end respectively pivoted to the foot base member, a main rack coupled to the power drive, and an auxiliary rack respectively meshed with the racks on the trunk cover shells. The power drive comprises a motor mount pivotably connected between the shoulder cover shells and the trunk cover shells by pivot means; a reversible motor mounted on the motor mount; a belt transmission mechanism; a transmission gear meshed between the main racks on the leg cover shells and coupled to the reversible motor through the belt transmission mechanism, the transmission gear moving the main racks alternatively up and down when the reversible motors is turned clockwise and counter-clockwise alternatively, causing the leg cover shells and the upper part of the toy body to be alternatively tilted inward and outward in reversed directions.

DETAILED DESCRIPTION OF THE PREFERRED EMBODIMENT

Figure 1:
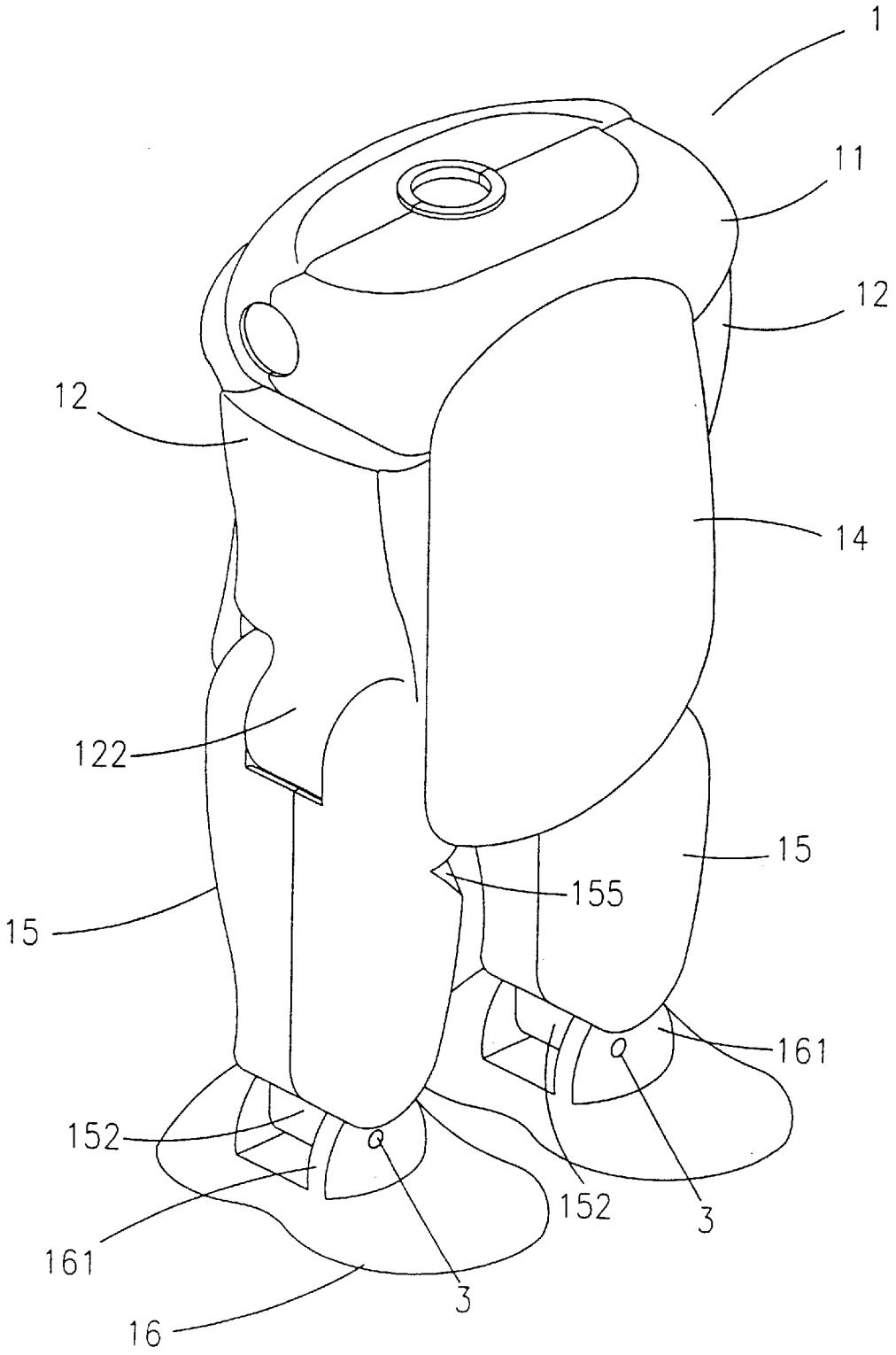
FIG. 1 is a perspective view of the present invention.
Figure 2:
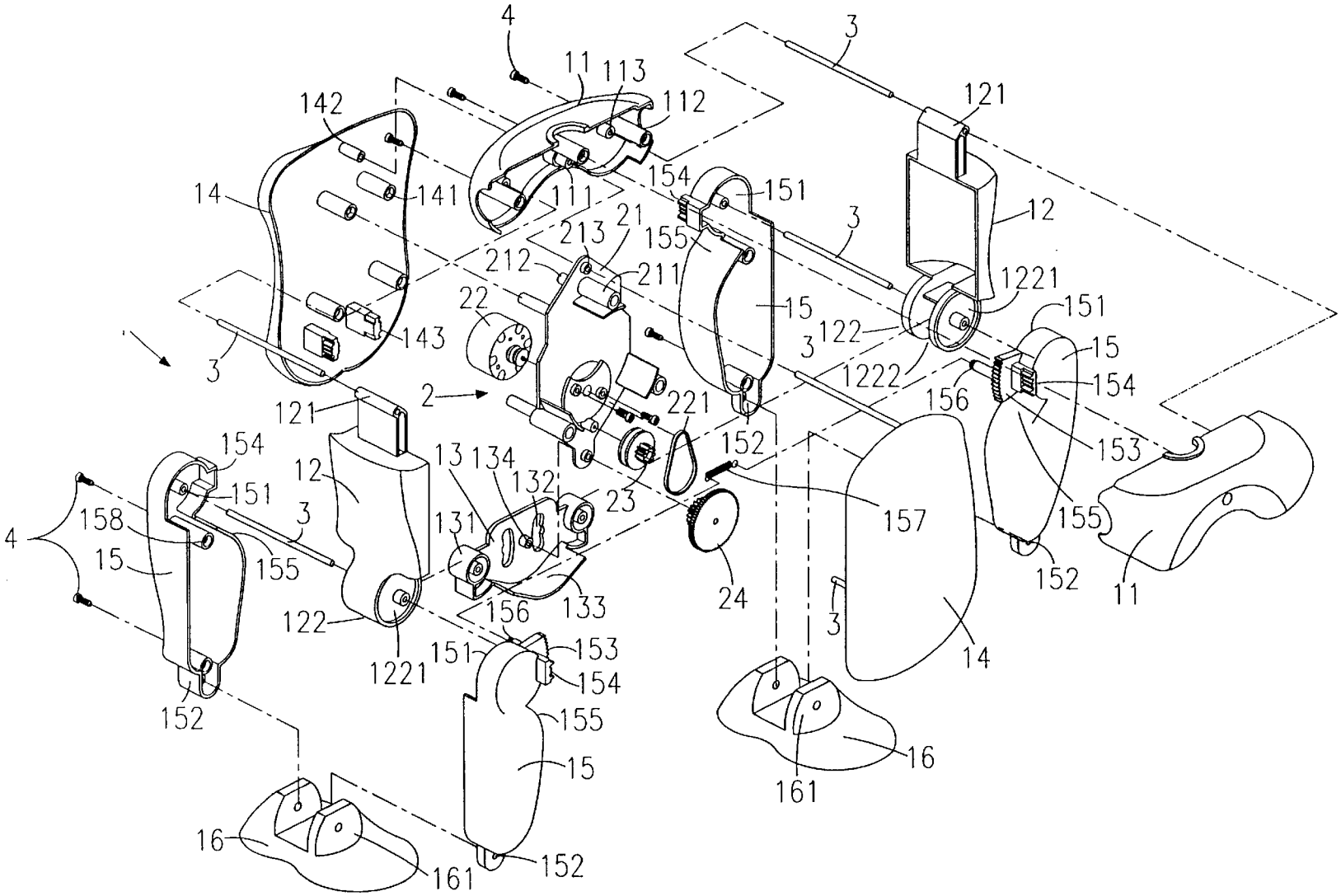
FIG. 2 is an exploded view of FIG. 1.
Figure 3:
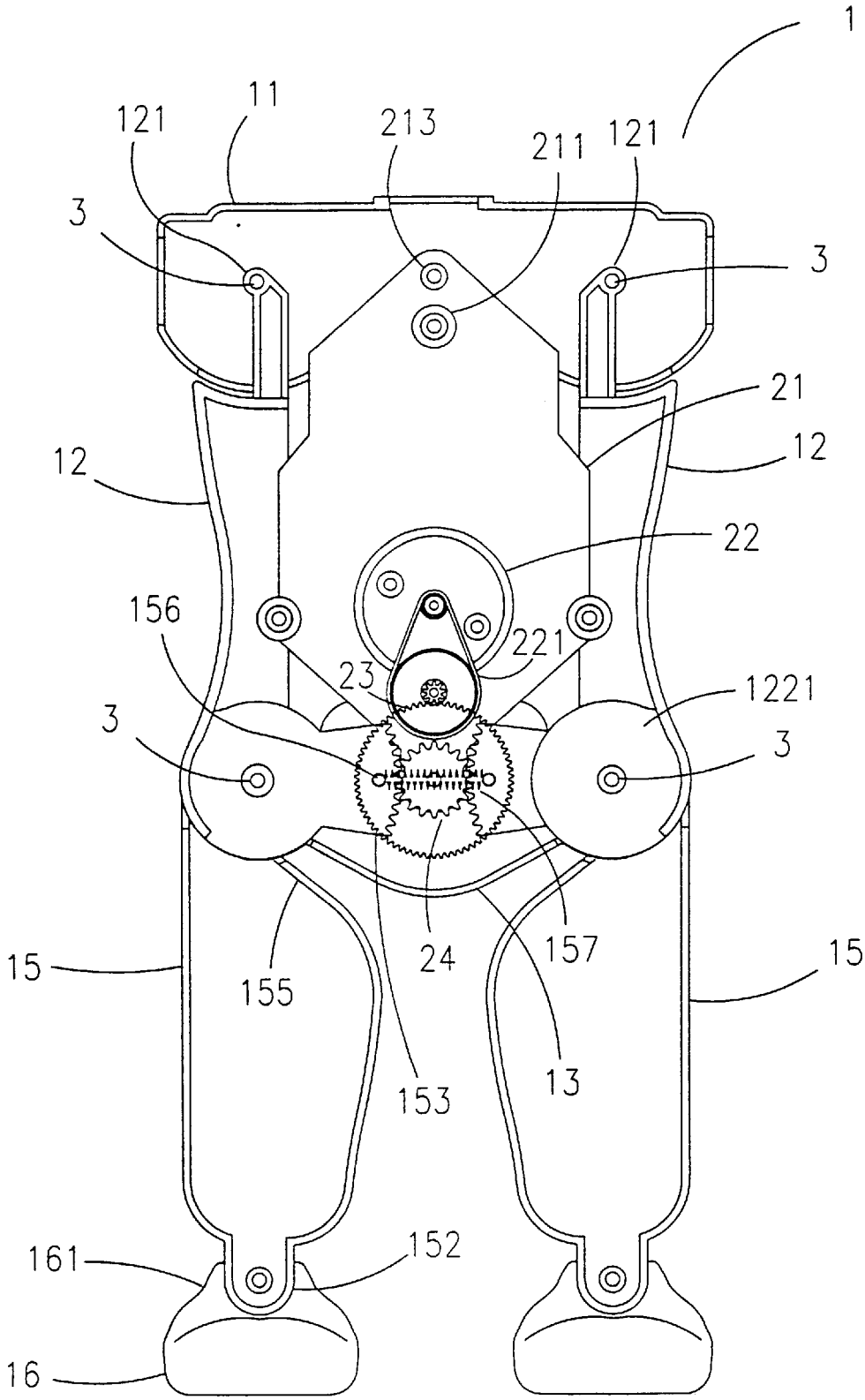
FIG. 3 is a front view in section of the present invention, showing the main racks on the leg cover shells meshed with the transmission gear.
Figure 4:
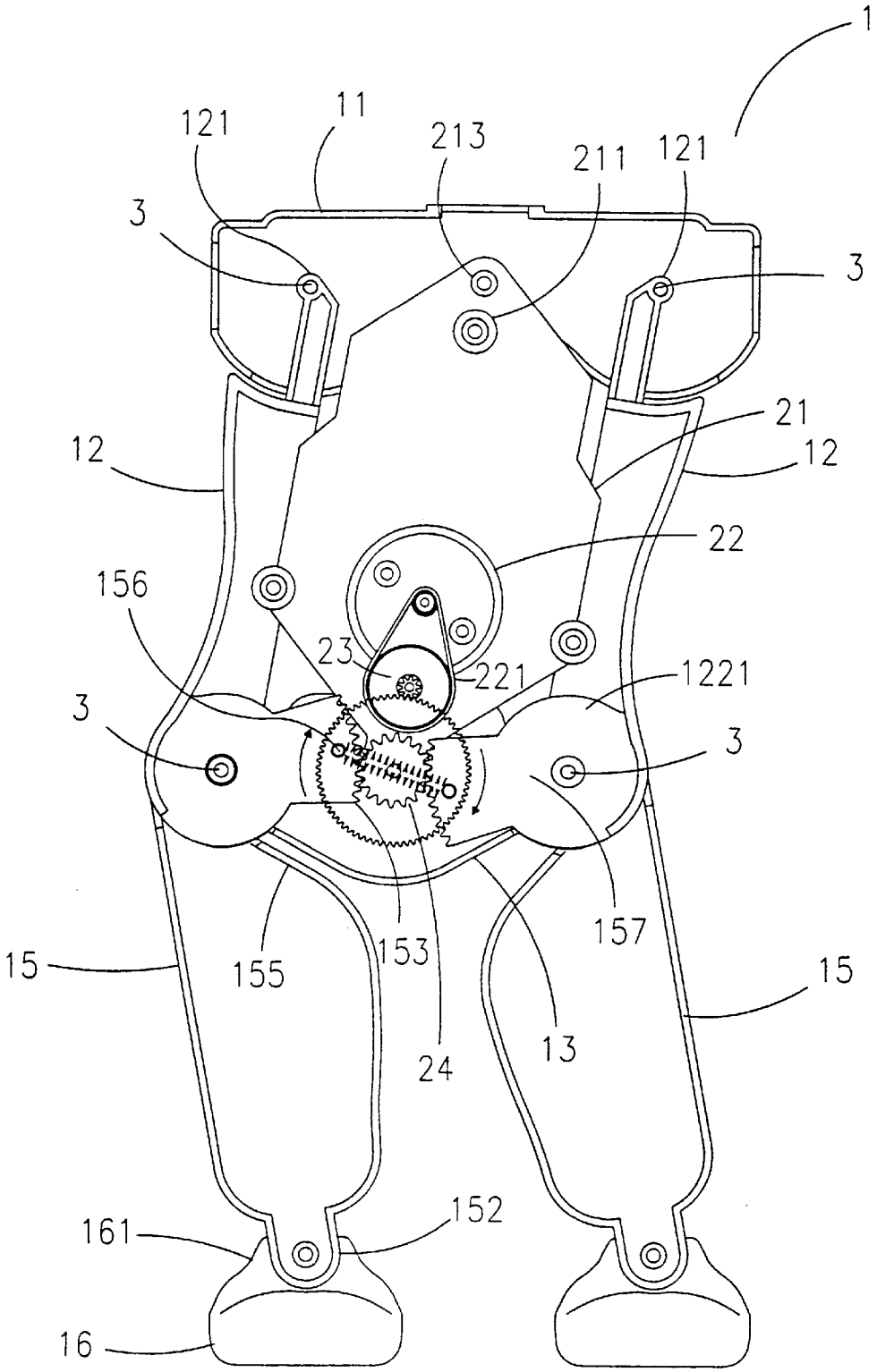
FIG. 4 illustrates the motion toy according to the present invention in operation, with the transmission gear turned clockwise.
Figure 5:
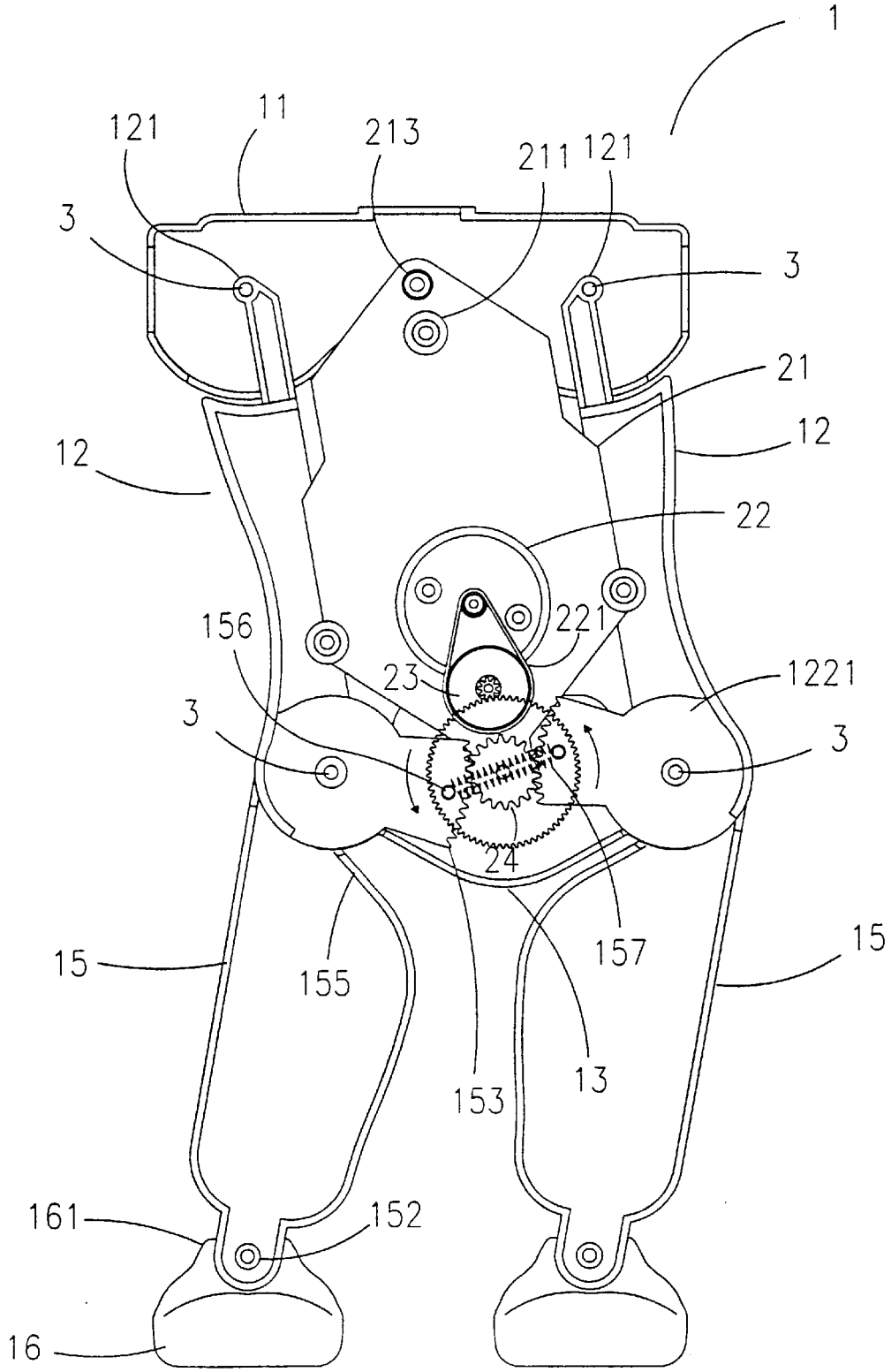
FIG. 5 illustrates the motion toy according to the present invention in operation, with the transmission gear turned counter-clockwise.

Referring to FIGS. 1 and 2, a motion toy in accordance with the present invention is generally comprised of a toy body 1, a power drive 2, and a plurality of pivot pins 3.

Figure 6:
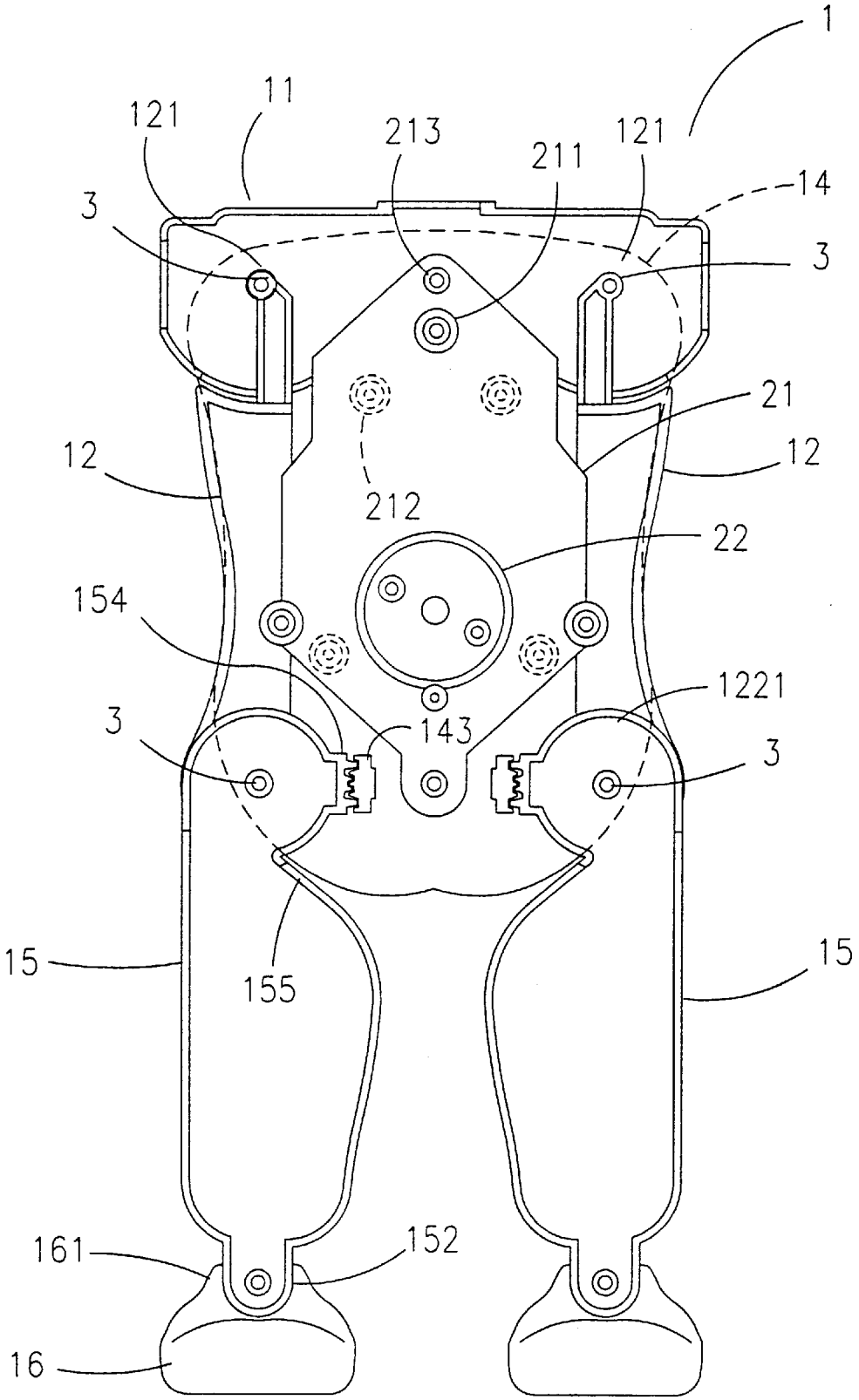
FIG. 6 is a front view in section of the present invention, showing the auxiliary racks on the leg cover shells meshed with the racks on the trunk cover shells.
Figure 7:
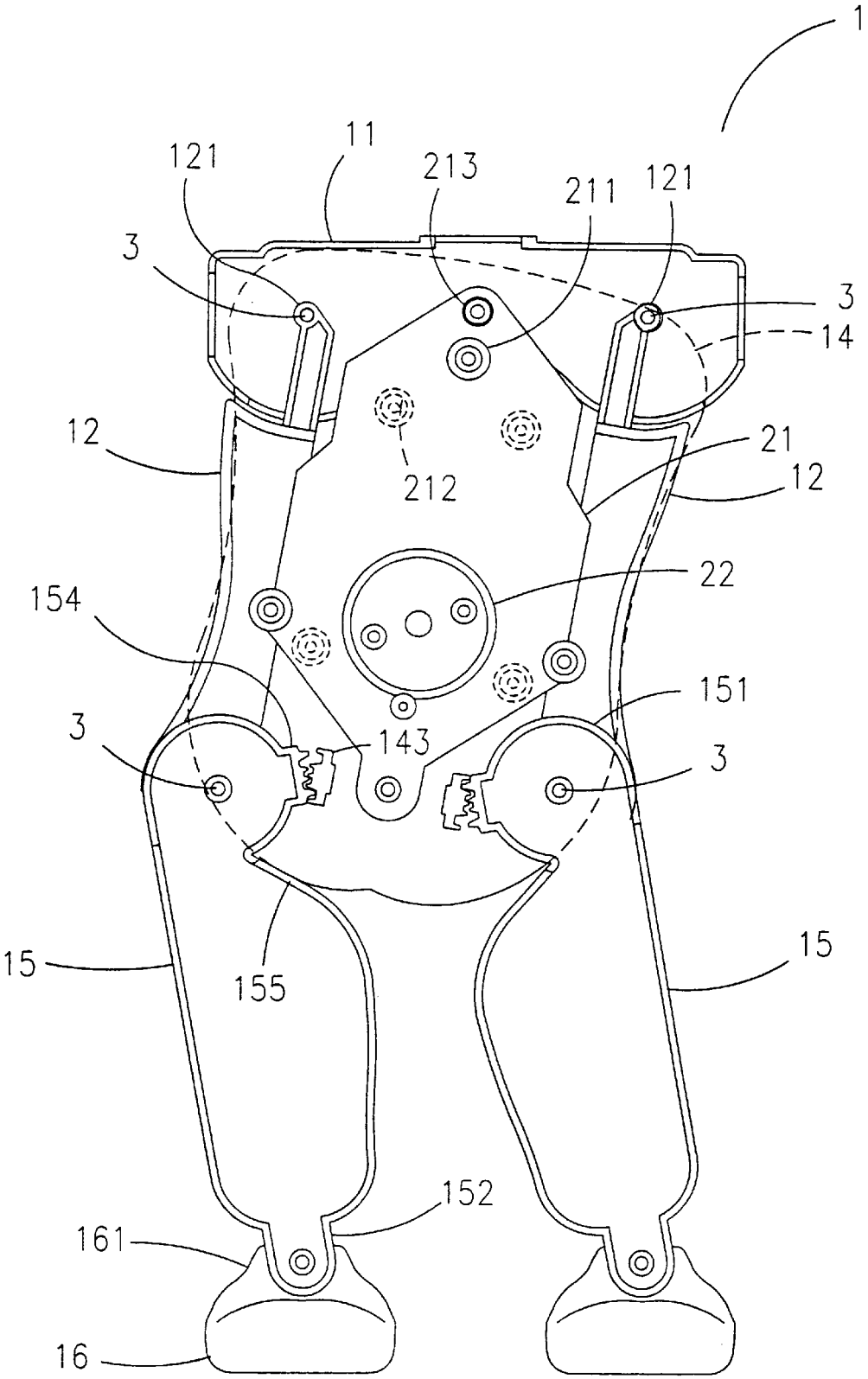
FIG. 7 is similar to FIG. 6 but showing the transmission gear turned clockwise, and the toy body twisted.
Figure 8:
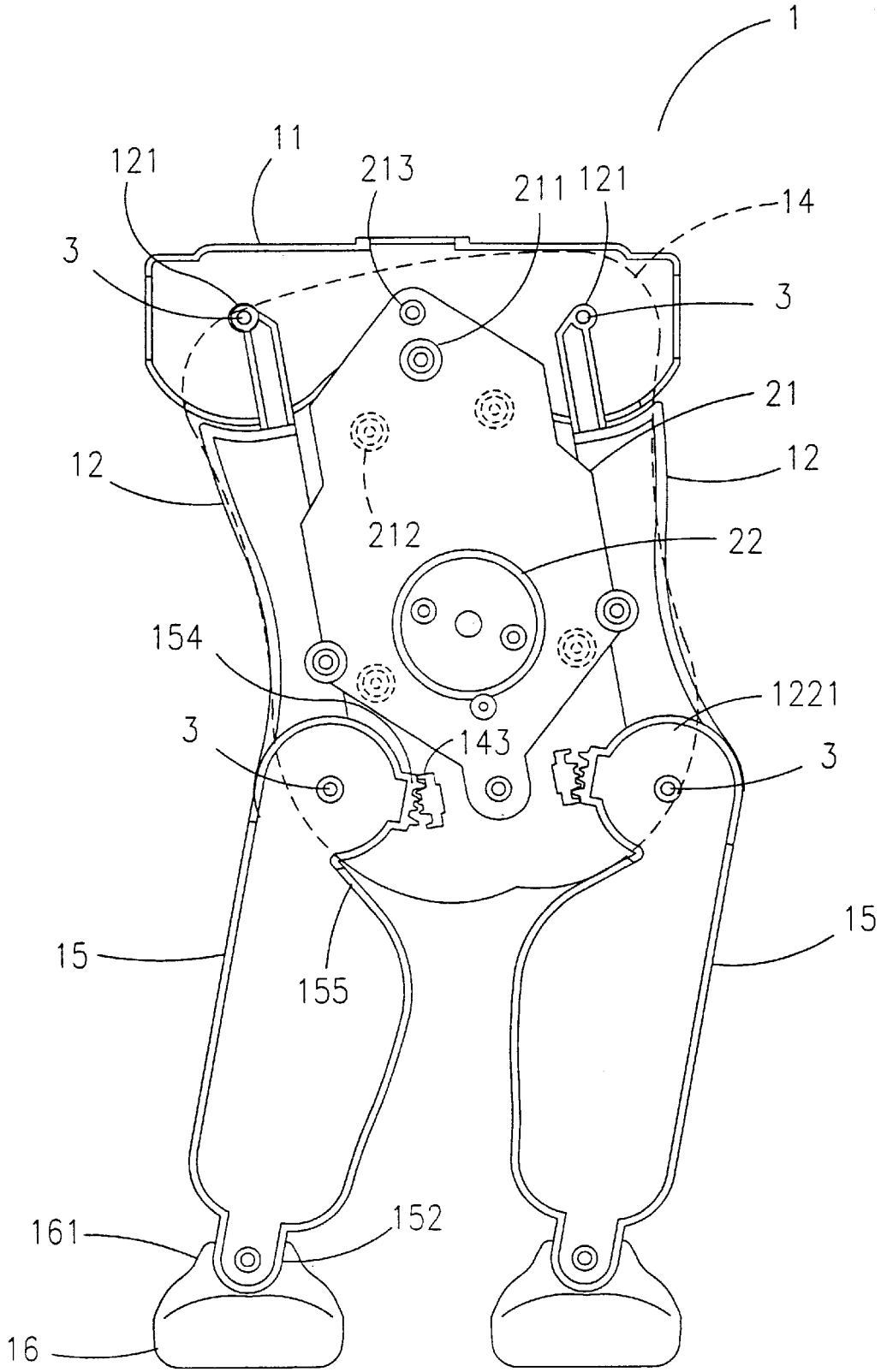
FIG. 8 is similar to FIG. 7 but showing the state where the transmission gear is turned counter-clockwise, and the toy body is twisted.

The toy body 1 is comprised of a shoulder cover unit having two symmetrical shoulder cover shells 11 connected together at the top, two symmetrical trunk cover shells 14 respectively connected to the shoulder cover shells 11, two symmetrical waist cover shells 12 respectively connected to the shoulder cover shells 11 between the trunk cover shells 14, a bottom bracket 13 connected between the waist cover shells 12 at the bottom, two foot base members 16, and two symmetrical pair of leg cover shells 15 bilaterally connected between the foot base members 16 and the waist cover shells 12. Three screws 4 are respectively mounted in respective mounting tubes 112 on one shoulder cover shell 11 and threaded into respective female screws (not shown) on the other shoulder cover shell 11 to secure the shoulder cover shells 11 together. Two pivot pins 3 are mounted in respective pivot holes 113 on the shoulder cover shells 11 and a respective pivot hole 121 at each waist cover shell 12 to pivotably secure the waist cover shells 12 to the shoulder cover shells 11 at two sides. Each waist cover shell 12 has a bottom coupling frame structure 122 comprised of two fixed disks 1221 and a receiving space 1222 defined between the fixed disks 1221. The leg cover shells 15 each have a top coupling portion 151 respectively covering the fixed disks 1221 of the waist cover shells 12 and pivotably secured thereto by a respective pivot pin 3, and a bottom lug 152 respectively pivotably connected to upright lugs 161 on the foot base members 16 by a respective pivot pin 3. The bottom bracket 13 has two barrels 131 at two opposite ends respectively inserted in the receiving spaces 1222 on the waist cover shells 12 and pivotably connected between the fixed disks 1221 on the waist cover shells 12 by the pivot pins 3 which are fastened to the fixed disks 1221. Two of the leg cover shells 15 have a respective locating rod 156 inserted through a respective arched slot 132 on the bottom bracket 13, and a tensile spring 157 is connected between the locating rods 156. The bottom bracket 13 has a smoothed arched bottom limit plate 133. The two leg cover shells 15 of the same pair are fastened together by plugging plug rods (not shown) on one leg cover shell into respective locating tubes 158 on the other. The power drive 2 comprises a motor mount 21 connected between the waist cover shells 12, a reversible motor 22 mounted on the motor mount 21, a belt wheel 23, a transmission belt 221 coupled between the reversible motor 22 and the belt wheel 23, and an oscillating transmission gear 24 coupled to the belt wheel 221. A pivot pin 3 is mounted in respective pivot holes 111 on the shoulder cover shells 11 and a top pivot hole 213 on the motor mount 21 to suspend the motor mount 21. A pivot pin 3 is fixedly perpendicularly fastened to one trunk cover shell 14 on the inside and inserted through the center hole on the transmission gear 24 and fastened to an axle hole 134 on the bottom bracket 13 between the arched slots 132, permitting the transmission gear 24 to be meshed between main racks 153 on the leg cover shell 15. The trunk cover shells 14 each have a pair of racks 143 respectively meshed with auxiliary racks 154 on the leg cover shells 15 (see also FIG. 6). The motor mount 21 has a plurality of mounting tubes 211 at one side respectively forced into engagement with respective mounting rods (not shown) on one trunk cover shell 14, and a plurality of mounting rods 212 at an opposite side respectively forced into engagement with respective mounting tubes 141 on the other trunk cover shell 14. The truck cover shells 14 further have respective mounting rods 142 respectively plugged into respective mounting tubes 112 on the shoulder cover shells 11.

Referring to FIGS. from 3 to 5, when the reversible motor 22 is turned clockwise or counter-clockwise, the belt wheel 23 is driven by the transmission belt 221 to rotate the transmission gear 24, thereby causing the main racks 153 to be moved upward or downward in reversed directions. When the main racks 153 of the leg cover shells 15 are alternatively moved up and down, the leg cover shells 15 are forced to tilt inward and outward.

Referring to FIGS. from 6 to 8, because the auxiliary racks 154 on the leg cover shells 15 are respectively meshed with the racks 143 on the trunk cover shells 14, the upper part of the toy body 1, namely, the waist cover shells 12, the trunk cover shells 14 and the shoulder cover shells 11 are tilted outward and inward when the leg cover shells 15 are tilted inward and outward. Further, the leg cover shells 15 each have a recessed portion 155 at an inner side corresponding to the smoothly arched bottom limit plate 133 on the bottom bracket 13 (see FIGS. 1, 3, 4 and 5). Because of the design of the recessed portion 155 at each leg cover shell 15, the foot cover shells 15 can be tilted inward at an angle. As shown in FIG. 2, the leg cover shells 15 are pivotally mounted with respect to the bottom bracket 13.

It will be understood from FIGS. 2 to 5 that gear teeth on the oscillating transmission gear 24 engage the gear teeth of main racks 153 to provide alternate movement of the leg cover shells 15. Gear teeth of the four racks 154 on the leg cover shells 15 engage gear teeth of four racks on the trunk cover shells 14. First and second racks 154 on the left leg cover shell 15 mesh respectively with a fifth rack 143 on the front trunk cover shell 14 and a seventh rack 143 on the rear trunk cover shell 14. Similarly, third and fourth racks 154 on the right leg cover shell 15 respectively engage a sixth rack 143 on the front trunk cover shell 14 and an eighth rack 143 on the rear trunk cover shell 14.

The upper body of the toy includes the shoulder 11, the trunk cover shells 14, the waist cover shells 12 and the bottom bracket 13. The upper body is supported on the legs 15. The lower portion of each of the upper body members 12 and 14 is provided with a pivot, and the upper portion of each of the legs 15 is provided with a pivot. All of these pivots on members 12, 14 and 15 are pivotally connected to the bottom bracket 13; they are at fixed positions relative to each other; and, they are moved together laterally, alternately in opposite directions, by the power drive of the toy. Due to the mechanical coupling provided by the racks 143 and 154, the legs 15 tilt in one direction when the upper body members 12 and 14 tilt in an opposite direction.

In the disclosed embodiment, the lower pivots of the trunk cover shells 14 are pivoted to the center of the bottom bracket 13, and the lower pivot of each of the waist cover shells 12 is pivotally connected, at a common pivot axis, to the bottom bracket 13 and to the upper pivot of a respective leg 15.

While only one embodiment of the present invention has been shown and described, it will be understood that various modifications and changes could be made thereunto without departing from the spirit and scope of the invention disclosed.

What the invention claimed is:

1. A movable toy, comprising:

a toy body, wherein the toy body includes:

a first shoulder cover shell;

a second shoulder cover shell;

a first trunk cover shell pivotally mounted with respect to the first shoulder cover shell;

a second trunk cover shell pivotally mounted with respect to the second shoulder cover shell;

a first waist cover shell pivotally mounted with respect to the first and second shoulder cover shells;

a second waist cover shell pivotally mounted with respect to the first and second shoulder cover shells;

a bottom bracket coupled between the first and second waist cover shells;

a first foot base member;

a second foot base member;

a first leg cover shell mounted between the first foot base member and the first waist cover shell, the first leg cover shell having a first end pivotally mounted with respect to the first waist cover shell and a second end pivotally mounted with respect to the first foot base member; and a second leg cover shell mounted between the second foot base member and the second waist cover shell, the second leg cover shell having a first end pivotally mounted with respect to the second waist cover shell and a second end pivotally mounted with respect to the second foot base member; and a power drive that moves the toy body such that the first and second leg cover shells alternately tilt in opposite directions, and the first and second waist cover shells tilt in directions which are opposite to the tilted directions of the first and second leg cover shells.

2. A movable toy according to claim 1, wherein the first leg cover shell includes a first rack, and the first trunk cover shell includes a rack engaged with the first rack.

3. A movable toy according to claim 1, wherein:

the first leg cover shell includes a first rack and a second rack, the second let, cover shell includes a third rack and a fourth rack, the first trunk cover shell includes a fifth rack engaged with the first rack and a sixth rack engaged with the third rack, and the second trunk cover shell includes a seventh rack engaged with the second rack and an eighth rack engaged with the fourth rack.

4. A movable toy according to claim 1, wherein the first ends of the first and second leg cover shells are pivotally connected to the bottom bracket.

5. A movable toy according to claim 1, wherein said bottom bracket, one of said leg cover shells and one of said waist cover shells are connected together at a common pivot axis.

6. A movable toy according to claim 1, including a motor mount which is pivotally connected to one of said shoulder cover shells and to the bottom bracket, said power drive including a motor mounted on the motor mount.

7. A movable toy according to claim 1, wherein said power drive includes a motor and a connection which drivingly connects the motor to one of said leg cover shells.

8. A movable toy according to claim 7, wherein said connection includes a gear.

9. A movable toy according to claim 7, wherein said motor is reversible.

10. A movable toy according to claim 1, wherein said power drive includes a motor, said leg cover shells include gear teeth thereon, and a transmission gear meshes with said gear teeth and is driven by said motor.

11. A movable toy according to claim 1, wherein said power drive includes a motor and an oscillating gear which is oscillated by said motor, said leg cover shells including gear teeth meshed with said oscillating gear.

12. A movable toy, comprising:

a toy body, wherein the toy body includes:

a shoulder cover unit;

a first trunk cover shell pivotally mounted with respect to the shoulder cover unit;

a second trunk cover shell pivotally mounted with respect to the shoulder cover unit;

a first waist cover shell pivotally mounted with respect to the shoulder cover unit;

a second waist cover shell pivotally mounted with respect to the shoulder cover unit;

a bottom bracket coupled between the first and second waist cover shells;

a first foot base member;

a second foot base member;

a first leg cover shell connected between the first foot base member and the first waist cover shell, the first leg cover shell having a first end pivotally mounted with respect to the first waist cover shell and a second end pivotally mounted with respect to the first foot base member; and a second leg cover shell connected between the second loot base member and the second waist cover shell, the second leg cover shell having a first end pivotally mounted with respect to the second waist cover shell and a second end pivotally mounted with respect to the second foot base member; and a power drive that moves the toy body such that the first and second leg cover shells alternately tilt in opposite directions, and the first and second waist cover shells tilt in directions which are opposite to the tilted directions of the first and second leg cover shells.

13. A movable toy according to claim 12, wherein the first leg cover shell includes a first rack, and the first trunk cover shell includes a rack engaged with the first rack.

14. A movable toy according to claim 12, wherein:

the first leg cover shell includes a first rack and a second rack, the second leg cover shell includes a third rack and a fourth rack, the first trunk cover shell includes a fifth rack engaged with the first rack and a sixth rack engaged with the third rack, and the second trunk cover shell includes a seventh rack engaged with the second rack and an eighth rack engaged with the fourth rack.

15. A movable toy according to claim 13, wherein the shoulder cover unit includes a first shoulder cover shell and a second shoulder cover shell.

16. A movable toy according to claim 12, wherein the first ends of the first and second leg cover shells are pivotally connected to the bottom bracket.

17. A movable toy according to claim 12, wherein said bottom bracket, one of said leg cover shells and one of said waist cover shells are connected together at a common pivot axis.

18. A movable toy according to claim 12, including a motor mount which is pivotally connected to the shoulder cover unit and to the bottom bracket, said power drive including a motor mounted on the motor mount.

19. A movable toy according to claim 12, wherein said power drive includes a motor and a connection which drivingly connects the motor to one of said leg cover shells.

20. A movable toy according to claim 19, wherein said connection includes a gear.

21. A movable toy according to claim 19, wherein said motor is reversible.

22. A movable toy according to claim 12, wherein said power drive includes a motor, said leg cover shells include gear teeth thereon, and a transmission gear meshes with said gear teeth and is driven by said motor.

23. A movable toy according to claim 14, wherein said power drive includes a motor and an oscillating gear which is oscillated by said motor, said leg cover shells including gear teeth meshed with said oscillating gear.

24. A toy body, comprising:

a first shoulder cover shell;

a second shoulder cover shell;

a first trunk cover shell pivotally mounted with respect to the first shoulder cover shell;

a second trunk cover shell pivotally mounted with respect to the second shoulder cover shell;

a first waist cover shell pivotally mounted with respect to the first and second shoulder cover shells;

a second waist cover shell pivotally mounted with respect to the first and second shoulder cover shells;

a bottom bracket coupled between the first and second waist cover shells;

a first foot base member:

a second foot base member;

a first leg cover shell mounted between the first foot base member and the first waist cover shell, the first leg cover shell having a first end pivotally mounted with respect to the first waist cover shell and a second end pivotally mounted with respect to the first foot base member; and a second leg cover shell mounted between the second foot base member and the second waist cover shell, the second leg cover shell having a first end pivotally mounted with respect to the second waist cover shell and a second end pivotally mounted with respect to the second foot base member.

25. A toy body according to claim 24, wherein the first leg cover shell includes a first rack, and the first trunk cover shell includes a second rack engaged with the first rack.

26. A toy body according to claim 24, wherein:

the first leg cover shell includes a first rack and a second rack, the second leg cover shell includes a third rack and a fourth rack, the first trunk cover shell includes a fifth rack engaged with the first rack and a sixth rack engaged with the third rack, and the second trunk cover shell includes a seventh rack engaged with the second rack and an eighth rack engaged with the fourth rack.

27. A toy body according to claim 24, wherein the first ends of the first and second leg cover shells are pivotally connected to the bottom bracket.

28. A toy body according to claim 24, wherein said bottom bracket one of said leg cover shells and one of said waist cover shells are connected together at a common pivot axis.

29. A toy body, comprising:

a shoulder cover unit;

a first trunk cover shell pivotally mounted with respect to the shoulder cover unit;

a second trunk cover shell pivotally mounted with respect to the shoulder cover unit;

a first waist cover shell pivotally mounted with respect to the shoulder cover unit;

a second waist cover shell pivotally mounted with respect to the shoulder cover unit;

a bottom bracket coupled between the first and second waist cover shells;

a first foot base member;

a second foot base member;

a first leg cover shell connected between the first foot base member and the first waist cover shell, the first leg cover shell having a first end pivotally mounted with respect to the first waist cover shell and a second end pivotally mounted with respect to the first foot base member; and a second leg cover shell connected between the second foot base member and the second waist cover shell, the second leg cover shell having a first end pivotally mounted with respect to the second waist cover shell and a second end pivotally mounted with respect to the second foot base member.

30. A toy body according to claim 29, wherein the first leg cover shell includes a first rack, and the first trunk cover shell includes a second rack engaged with the first rack.

31. A toy body according to claim 29, wherein:

the first leg cover shell includes a first rack and a second rack, the second leg cover shell includes a third rack and a fourth rack, the first trunk cover shell includes a fifth rack engaged with the first rack and a sixth rack engaged with the third rack, and the second trunk cover shell includes a seventh rack engaged with the second rack and an eighth rack engaged with the fourth rack.

32. A toy body according to claim 30, wherein the shoulder cover unit includes a first shoulder cover shell and a second shoulder cover shell.

33. A toy body according to claim 29, wherein the first ends of the first and second leg cover shells are pivotally connected to the bottom bracket.

34. A toy body according to claim 29, wherein said bottom bracket, one of said leg cover shells and one of said waist cover shells are connected together at a common pivot axis.

35. A movable toy, comprising:

a toy body, wherein the toy body includes:

a first shoulder cover shell;

a second shoulder cover shell;

a first trunk cover shell pivotally mounted with respect to the first shoulder cover shell;

a second trunk cover shell pivotally mounted with respect to the second shoulder cover shell;

a first waist cover shell pivotally mounted with respect to the first and second shoulder cover shells;

a second waist cover shell pivotally mounted with respect to the first and second shoulder cover shells;

a bottom bracket extending from the first waist cover shell to the second waist cover shell;

a first foot base member;

a second foot base member;

a first leg cover shell having a first end pivotally mounted with respect to the bottom bracket and a second end pivotally mounted with respect to the first foot base member; and a second leg cover shell having a first end pivotally mounted with respect to the bottom bracket and a second end pivotally mounted with respect to the second foot base member; and a power drive that moves the toy body such that the first and second leg cover shells alternately tilt in opposite directions, and the first and second waist cover shells tilt in directions which are opposite to the tilted directions of the first and second leg cover shells.

36. A movable toy according to claim 35, wherein the first leg cover shell includes a first rack, and the first trunk cover shell includes a rack engaged with the first rack.

37. A movable toy according to claim 35, wherein:

the first leg cover shell includes a first rack and a second rack, the second leg cover shell includes a third rack and a fourth rack, the first trunk cover shell includes a fifth rack engaged with the first rack and a sixth rack engaged with the third rack, and the second trunk cover shell includes a seventh rack engaged with the second rack and an eighth rack engaged with the fourth rack.

38. A movable toy according to claim 35, including a motor mount which is pivotally connected to one of said shoulder cover shells and to the bottom bracket, said power drive including a motor mounted on the motor mount.

39. A movable toy according to claim 35, wherein said power drive includes a motor and a connection which drivingly connects the motor to one of said leg cover shells.

40. A movable toy according to claim 39, wherein said connection includes a gear.

41. A movable toy according to claim 39, wherein said motor is reversible.

42. A movable toy according to claim 35, wherein said power drive includes a motor, said leg cover shells include gear teeth thereon, and a transmission gear meshes with said gear teeth and is driven by said motor.

43. A movable toy according to claim 35, wherein said power drive includes a motor and an oscillating gear which is oscillated by said motor, said leg cover shells including gear teeth meshed with said oscillating gear.

44. A movable toy, comprising:

a toy body, wherein the toy body includes:

a shoulder cover unit;

a first trunk cover shell pivotally mounted with respect to the shoulder cover unit;

a second trunk cover shell pivotally mounted with respect to the shoulder cover unit;

a first waist cover shell pivotally mounted with respect to the shoulder cover unit;

a second waist cover shell pivotally mounted with respect to the shoulder cover unit;

a bottom bracket extending from the first waist cover shell to the second waist cover shell;

a first foot base member;

a second foot base member;

a first leg cover shell having a first end pivotally mounted with respect to the bottom bracket and a second end pivotally mounted with respect to the first foot base member; and a second leg cover shell having a first end pivotally mounted with respect to the bottom bracket and a second end pivotally mounted with respect to the second foot base member; and a power drive that moves the toy body such that the first and second leg cover shells alternately tilt in opposite directions, and the first and second waist cover shells tilt in directions which are opposite to the tilted directions of the first and second leg cover shells.

45. A movable toy according to claim 44, wherein the first leg cover shell includes a first rack, and the first trunk cover shell includes a rack engaged with the first rack.

46. A movable toy according to claim 44, wherein:

the first leg cover shell includes a first rack and a second rack, the second leg cover shell includes a third rack and a fourth rack, the first trunk cover shell includes a fifth rack engaged with the first rack and a sixth rack engaged with the third rack, and the second trunk cover shell includes a seventh rack engaged with the second rack and an eighth rack engaged with the fourth rack.

47. A movable toy according to claim 44, wherein the shoulder cover unit includes a first shoulder cover shell and a second shoulder cover shell.

48. A movable toy according to claim 44, including a motor mount which is pivotally connected to the shoulder cover unit and to the bottom bracket, said power drive including a motor mounted on the motor mount.

49. A movable toy according to claim 44, wherein said power drive includes a motor and a connection which drivingly connects the motor to one of said leg cover shells.

50. A movable toy according to claim 49, wherein said connection includes a gear.

51. A movable toy according to claim 49, wherein said motor is reversible.

52. A movable toy according to claim 44, wherein said power drive includes a motor, said leg cover shells include gear teeth thereon, and a transmission gear meshes with said gear teeth and is driven by said motor.

53. A movable toy according to claim 44, wherein said power drive includes a motor and an oscillating gear which is oscillated by said motor, said leg cover shells including gear teeth meshed with said oscillating gear.

54. A toy body, comprising:

a first shoulder cover shell;

a second shoulder cover shell;

a first trunk cover shell pivotally mounted with respect to the first shoulder cover shell;

a second trunk cover shell pivotally mounted with respect to the second shoulder cover shell;

first waist cover shell pivotally mounted with respect to the first and second shoulder cover shells;

a second waist cover shell pivotally mounted with respect to the first and second shoulder cover shells;

a bottom bracket extending from the first waist cover shell to the second waist cover shell;

a first foot base member;

a second foot base member;

a first leg cover shell having a first end pivotally mounted with respect to the bottom bracket and a second end pivotally mounted with respect to the first foot base member; and a second leg cover shell having a first end pivotally mounted with respect to the bottom bracket and a second end pivotally mounted with respect to the second foot base member.

55. A toy body according to claim 54, wherein the first leg cover shell includes a first rack, and the first trunk cover shell includes a rack engaged with the first rack.

56. A toy body according to claim 54, wherein:

the first leg cover shell includes a first rack and a second rack, the second leg cover shell includes a third rack and a fourth rack, the first trunk cover shell includes a fifth rack engaged with the first rack and a sixth rack engaged with the third rack, and the second trunk cover shell includes a seventh rack engaged with the second rack and an eighth rack engaged with the fourth rack.

57. A toy body, comprising:

a shoulder cover unit;

a first trunk cover shell pivotally mounted with respect to the shoulder cover unit;

a second trunk cover shell pivotally mounted with respect to the shoulder cover unit;

a first waist cover shell pivotally mounted with respect to the shoulder cover unit;

a second waist cover shell pivotally mounted with respect to the shoulder cover unit;

a bottom bracket extending from the first waist cover shell to the second waist cover shell;

a first foot base member;

a second foot base member;

a first leg cover shell having a first end pivotally mounted with respect to the bottom bracket and a second end pivotally mounted with respect to the first foot base member; and a second leg cover shell having a first end pivotally mounted with respect to the bottom bracket and a second end pivotally mounted with respect to the second foot base member.

58. A toy body according to claim 57, wherein the first leg cover shell includes a first rack, and the first trunk cover shell includes a rack engaged with the first rack.

59. A toy body according to claim 57, wherein:

the first leg cover shell includes a first rack and a second rack, the second leg cover shell includes a third rack and a fourth rack, the first trunk cover shell includes a fifth rack engaged with the first rack and a sixth rack engaged with the third rack, and the second trunk cover shell includes a seventh rack engaged with the second rack and an eighth rack engaged with the fourth rack.

60. A toy body according to claim 57, wherein the shoulder cover unit includes a first shoulder cover shell and a second shoulder cover shell.

61. A movable toy, comprising:

a toy body, wherein the toy bode includes:

a shoulder unit;

a first waist member pivotally mounted with respect to the shoulder unit;

a second waist member pivotally mounted with respect to the shoulder unit;

a first trunk member pivotally mounted with respect to the shoulder unit;

a second trunk member pivotally mounted with respect to the shoulder unit;

a hip bracket extending from the first waist member to the second waist member;

a first foot support;

a second foot support;

a first leg member having a first end pivotally connected to at least one of the hip bracket or the first waist member, and a second end pivotally mounted with respect to the first foot support;

a second leg member having a first end pivotally connected to at least one of the hip bracket or the second waist member, and a second end pivotally mounted with respect to the second foot support, wherein the first leg member includes a first rack and a second rack, the second leg member includes a third rack and a fourth rack, the first trunk member includes a fifth rack engaged with the first rack and a sixth rack engaged with the third rack, and the second trunk member includes a seventh rack engaged with the second rack and an eighth rack engaged with the fourth rack; and a power drive that moves the toy body such that the first and second leg members alternately tilt in opposite directions, and the first and second waist members tilt in directions which are opposite to the tilted directions of the first and second leg members.

62. A toy body, comprising:

a shoulder unit;

a first waist member pivotally mounted with respect to the shoulder unit;

a second waist member pivotally mounted with respect to the shoulder unit;

a first trunk member pivotally mounted with respect to the shoulder unit;

a second trunk member pivotally mounted with respect to the shoulder unit;

a hip bracket extending from the first waist member to the second waist member;

a first foot support;

a second foot support;

a first leg member having a first end pivotally connected to at least one of the hip bracket or the first waist member, and a second end pivotally mounted with respect to the first foot support; and a second leg member having a first end pivotally connected to at least one of the hip bracket or the second waist member, and a second end pivotally mounted with respect to the second foot support, wherein the first leg member includes a first rack and a second rack, the second leg member includes a third rack and a fourth rack, the first trunk member includes a fifth rack engaged with the first rack and a sixth rack engaged with the third rack, and the second trunk member includes a seventh rack engaged with the second rack and an eighth rack engaged with the fourth rack.

63. A movable toy according to claim 1, wherein the toy includes a mechanical coupling, and the opposite tilting directions of said waist cover shells and said trunk cover shells is provided by said mechanical coupling.

64. A movable toy according to claim 12, wherein the toy includes a mechanical coupling, and the opposite tilting directions of said waist cover shells and said trunk cover shells is provided by said mechanical coupling.

65. A toy body according to claim 24, wherein the toy includes a mechanical coupling, and the opposite tilting directions of said waist cover shells and said trunk cover shells is provided by said mechanical coupling.

66. A toy body according to claim 29, wherein the toy includes a mechanical coupling, and the opposite tilting directions of said waist cover shells and said trunk cover shells is provided by said mechanical coupling.

67. A toy body according to claim 35, wherein the toy includes a mechanical coupling, and the opposite tilting directions of said waist cover shells and said trunk cover shells is provided by said mechanical coupling.

68. A movable toy according to claim 44, wherein the toy includes a mechanical coupling, and the opposite tilting directions of said waist cover shells and said trunk cover shells is provided by said mechanical coupling.

69. A toy body according to claim 54, wherein the toy includes a mechanical coupling, and the opposite tilting directions of said waist cover shells and said trunk cover shells is provided by said mechanical coupling.

70. A toy body according to claim 57, wherein the toy includes a mechanical coupling, and the opposite tilting directions of said waist cover shells and said trunk cover shells is provided by said mechanical coupling.

71. A toy body, comprising:

a first upper body member having a lower portion provided with a pivot, wherein said first upper body member is a first waist cover shell;

a second upper body member having, a lower portion provided with a pivot, wherein said second upper body member is a second waist cover shell;

a first leg member having an upper portion provided with a pivot, said pivot of said first leg member being movable with and at a fixed position relative to said pivot of said first upper body member;

a second leg member having an upper portion provided with a pivot, said pivot of said second leg member being movable with and at a fixed position relative to said pivot of said second upper body member;

said members being laterally tiltable, said pivots being laterally movable when said members tilt;

said members being mechanically coupled together to tilt the upper body members in one direction when said leg members are tilted in an opposite direction.

72. A movable toy according to claim 63, wherein the mechanical coupling includes interengaging racks.

73. A movable toy according to claim 64, wherein the mechanical coupling includes interengaging racks.

74. A movable toy according to claim 65, wherein the mechanical coupling includes interengaging racks.

75. A movable toy according to claim 66, wherein the mechanical coupling includes interengaging racks.

76. A movable toy according to claim 67, wherein the mechanical coupling includes interengaging racks.

77. A movable toy according to claim 68, wherein the mechanical coupling includes interengaging racks.

78. A movable toy according to claim 69, wherein the mechanical coupling includes interengaging racks.

79. A movable toy according to claim 70, wherein the mechanical coupling includes interengaging racks.

* * * * *